United States Patent [19]

Lee

[11] 4,400,612

[45] Aug. 23, 1983

[54] OVEN FOR SKIN PACKAGING MACHINE

[75] Inventor: Cleve L. Lee, Anderson, S.C.

[73] Assignee: Nordson Corporation, Amherst, Ohio

[21] Appl. No.: 261,003

[22] Filed: May 6, 1981

[51] Int. Cl.[3] ..... F27D 11/00

[52] U.S. Cl. ..... 219/405; 53/509; 219/347; 219/351; 219/352; 219/411; 219/532; 219/537; 219/388; 219/377

[58] Field of Search ..... 219/350–357, 219/388, 377, 411, 347, 349, 377, 532; 99/425; 53/30, 184, 509, 559, 449

[56] References Cited

U.S. PATENT DOCUMENTS

| | | | |
|---|---|---|---|
| 2,599,029 | 6/1952 | Turner et al. | 219/347 |
| 2,756,319 | 7/1956 | Hatch | 219/347 X |
| 2,764,664 | 9/1956 | Stewart | 219/411 X |
| 3,066,211 | 11/1962 | Vogt | 219/411 X |
| 3,322,946 | 5/1967 | Cooper | 219/347 X |
| 3,377,770 | 4/1968 | Rorer | 53/509 |
| 3,403,243 | 9/1968 | Martz et al. | 219/411 |
| 3,501,886 | 3/1970 | Watts, Jr. et al. | 53/509 X |
| 3,512,335 | 5/1970 | Rorer | 53/509 |
| 3,621,200 | 11/1971 | Watts | 219/377 |
| 3,622,750 | 11/1971 | Watts, Jr. | 219/377 |
| 3,714,885 | 2/1973 | Wertheimer | 99/425 |
| 3,760,154 | 9/1973 | Konger | 219/388 |
| 3,965,868 | 12/1960 | Eichler | 219/347 X |
| 4,180,721 | 12/1979 | Watanabe et al. | 219/216 |
| 4,238,995 | 12/1980 | Polster | 219/411 X |
| 4,322,605 | 3/1982 | Stimens | 219/532 |
| 4,338,769 | 7/1982 | Jones | 53/509 |

*Primary Examiner*—Volodymyr Y. Mayewsky
*Attorney, Agent, or Firm*—Wood, Herron & Evans

[57] ABSTRACT

A film heating oven for a skin packaging machine. The oven has a metallic housing in which are supported a plurality of elongated heaters in spaced parallel relationship. The heaters are energized by a control system which raises their temperature for heating the film and lowers the temperature during other operations of the machine. The housing includes a reflector for each tube to direct the heat downwardly onto the film and further includes an outer covering of insulation to minimize the escape of heat.

1 Claim, 4 Drawing Figures

OVEN FOR SKIN PACKAGING MACHINE

This invention relates to a skin packaging machine, and more particularly, the invention relates to the oven for such a machine.

A skin packaging machine includes a supporting base having a horizontal foraminous surface for supporting a porous board and an article to be packed. An oven overlies the horizontal surface and a frame is located between the oven and surface to carry film between the oven and the surface. A source of vacuum is provided underneath the surface in order to draw a heated film down upon the porous board or substrate so that it surrounds the article and secures it to the board.

The function of the oven is to raise the temperature of the film until it becomes "droopy" and to continue to apply heat to the film as it is brought down to the board and vacuum applied in order to draw the film down around the article. After the film is secured to the board and article, a new supply of film is drawn into the frame as the board with its skin packed article is removed from the surface. The frame is then raised and a fresh board and article are brought into position underneath the film. During this latter period, it is important to keep heat off the new film so that it does not become overheated.

To keep heat off the film, different approaches have been tried. Shutters have been employed to cover the heating elements. Fans have been employed to blow air across the heating elements. Energy has been totally shut off to the heating elements. In general, these approaches have been directed toward getting rid of the heat of the oven so that the film is not overheated.

An objective of the present invention has been to provide an oven in which the heat required to perform the operations of the skin packaging machine is conserved.

This objective of the invention has been attained by providing an oven having a housing, a plurality of elongated spaced parallel heating elements mounted on the housing, a reflector for each of the heating elements to direct the heat from the elements upon the film, and an insulative backing to retain the heat within the oven. The invention further includes the use of a control system for applying energy to the heating elements, the control system being that of the Jones application Serial No. 245,752 filed Mar. 20, 1981, now U.S. Pat. No. 4,338,769. In accordance with the Jones control system, high energy is applied to the heating elements during that period of time when it is desired to direct heat onto the film. During the remainder of the operating cycle of the machine, a low energy is applied to the heating elements to avoid overheating the fresh supply of film. Preferably, the heating elements consist of quartz tubes which are helically wound with a nichrome ribbon which has a very quick response to the changes in the energy input.

When these elements, as described above, are combined, the oven provides heat which is directly applied to the film by the reflectors only when the heat is needed. Thereafter, a low heat is applied to the heating elements, that low heat being just sufficient to keep the heating elements at a heat level high enough to reduce the time required to raise the temperature to a high enough level for the operation under high heat. The insulation surrounding the oven is employed to retain heat and thus reduce the energy required to keep the elements at low heat during the remainder of the cycle of operations.

The combining of these elements has produced a dramatic improvement in the heat required for the overall operation. For example, in prior skin packaging apparatus 10,000 watts of heat would be applied to the film for ten seconds. With the present invention, 10,000 watts would be applied to the film for seven seconds thereby reducing the energy required by about 30 percent.

The several features and objectives of the invention will become more readily apparently from the following detailed description taken in conjunction with the accompanying drawings in which.

Figure 1:
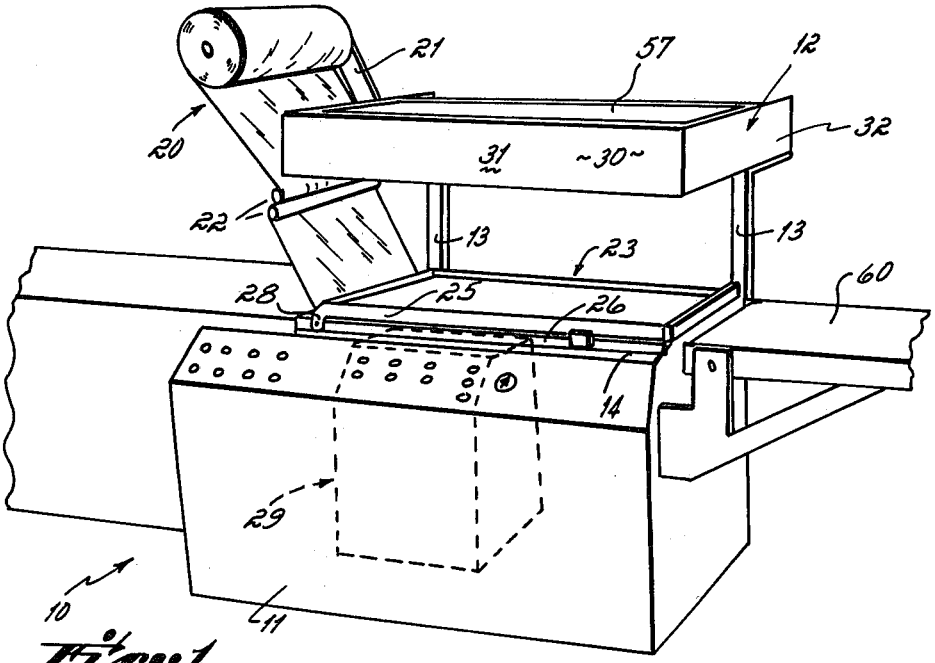
FIG. 1 is a diagrammatic perspective view of a skin packaging machine.

Referring to FIG. 1, the skin packaging machine is indicated at 10 and includes a base 11 on which an oven 12 is mounted by posts 13. The base includes a flat foraminous surface 14. A source of vacuum (not shown) is applied to the foraminous surface in order to draw the film down upon a porous board and article mounted on the foraminous surface.

A supply of film 20 is mounted on a bracket 21 and passes over rollers 22 into a frame 23. The frame or clamp has upper and lower jaws 25 and 26 which are hinged together at 28. A transmission, mounted on the posts 13, is provided to raise and lower the frame 23 carrying the film 20 with it up to the oven 12 and down upon the board resting on the foraminous surface 14.

Within the base 11 is an electronic control 29 for the heat to the oven, the control preferably being that of the Jones U.S. Pat. No. 4,338,769. That control applies a high level of energy to the heating when desired to heat the film. During the remainder of the operating cycle a low level of energy is applied to the heating elements.

Figure 2:
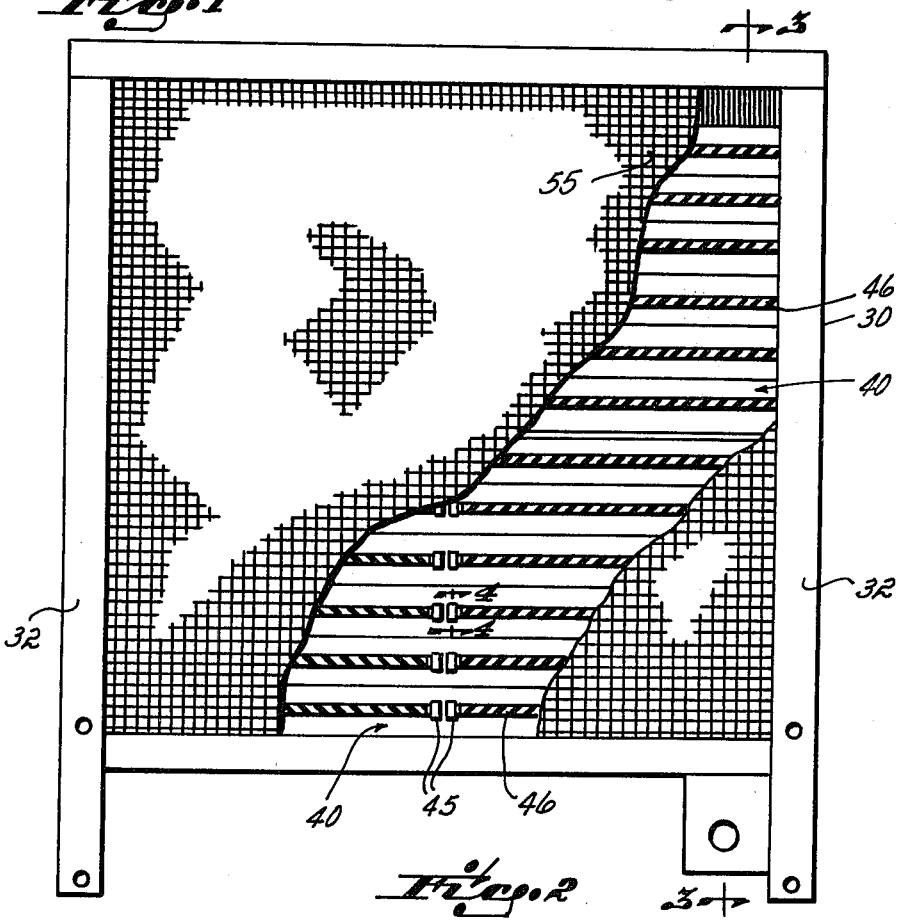
FIG. 2 is a bottom plan view of the oven for the machine.
Figure 3:
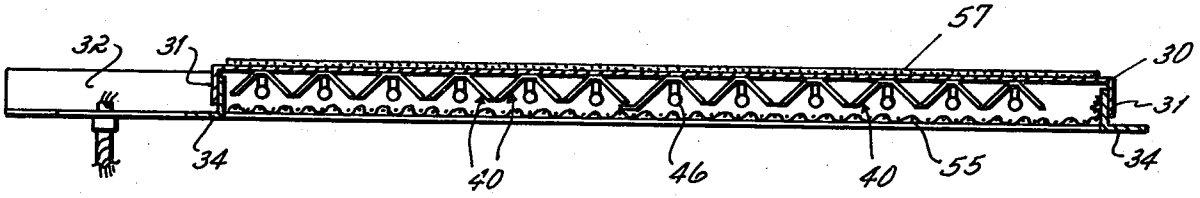
FIG. 3 is a cross sectional view taken along lines 3—3 of FIG. 2.
Figure 4:
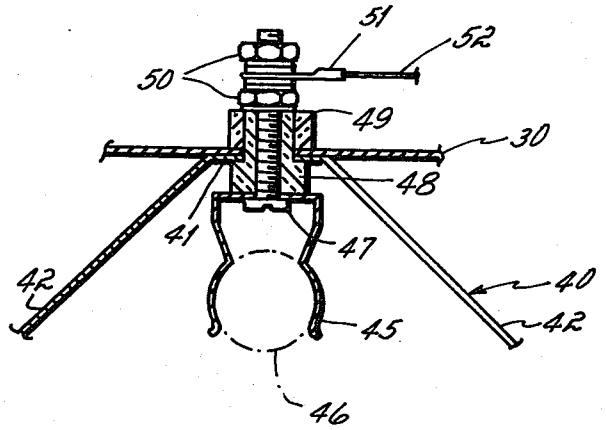
FIG. 4 is a cross sectional view taken along lines 4—4 of FIG. 2.

The oven is illustrated in FIGS. 2, 3 and 4. It includes a metallic housing 30 formed as an inverted, flat tray having downwardly depending side walls 31 around its perimeter. The oven is mounted between two angled support elements 32 on two of its sides, the support elements being mounted to the posts 13. Reinforcing angles 34 are mounted on the remaining two sides of the housing.

Within the housing are a plurality of channel-shaped reflectors 40 each having a bright, downwardly-facing surface formed, for example, by aluminizing the surface of a steel reflector. As best shown in FIG. 4, each reflector includes a flat base 41 and a pair of wings 42 projecting downwardly and outwardly from the flat base. The configuration of the reflectors may be varied without departing from the invention, although it is preferred to maintain a flat base 41 for the purpose of maintaining the heating elements, as will appear below. Each reflector is mounted directly to the housing 30.

Each reflector has four electrical connectors 45 for mounting two heating elements 46 end-to-end. Each electrical connector is in the form of a fuse clip which is secured to the reflector and housing at the flat base 41 of the reflector by means of a bolt 47. An insulative ceramic bushing 48 having a hole through it is interposed between the fuse clip 45 and the reflector and housing.

A ceramic bushing 49 is mounted on the opposite surface of the housing with that assembly being secured by a pair of nuts and washers indicated at 50. A connector clip 51 is interposed between the two nuts to connect a terminal 52 to the electrical connector. The terminals for each heating element are connected to the power supply and control system 29 therefor.

A screen 55 is mounted across the open face of the oven to prevent inadvertent touching of the heater elements within the housing.

The outer surface of the housing is provided with insulative material 57. The insulative material is of any suitable type. Its function is primarily to retain the heat within the oven and thus reduce the energy required during the overall operation of the machine.

The heating elements are preferably of the type disclosed in U.S. Pat. No. 3,621,200 and consist of quartz tubes surrounded by thin nichrome ribbon which is helically wound upon the tubes. The flat ribbons provide a rather quick response to the input and withdrawal of energy to the heating elements so that when combined with the reflectors, high energy can be immediately applied to the film when it is desired and substantially no energy applied to the film when it is not desired.

In the operation of the invention, film is brought into position between the upper and lower jaws 25 and 26 of the frame 23. The frame is raised to a position adjacent the oven and high energy is applied to the heating elements 46. The reflectors, which preferably have a bright surface, direct the heat from the heating elements down upon the film. When the film is heated to the extent that it becomes "droopy" the frame is lowered to a position adjacent the board and article which rest upon the foraminous surface 14. Vacuum is applied to draw the film down upon the board and the article to be packaged on the board. Thereafter, the energy applied to the heating elements is reduced to a low level so as to avoid degrading the fresh supply of film to be drawn into the frame.

When the film is secured to the board, the jaws of the frame are opened and the board is moved laterally onto the surface 60. In moving the board laterally, a fresh supply of film is pulled into the frame 23. A knife, (not shown), cuts the film between the fresh supply and that on the board. The frame is then raised to an intermediate position between the oven and the surface 14 and a new board with one or more articles mounted upon it are brought into position over the foraminous surface. Thereafter, the cycle of operations is repeated.

It can be appreciated that by using quick response heating elements of the type described: a high energy, low energy control system for the heating elements; reflectors; and insulation, the overall heat required for a cycle of operations can be greatly reduced, thereby improving the efficiency of the machine. The reflectors apply heat directly to the film so that waste of the heat is minimized. The insulation retains heat so that during the low energy portion of the cycle, the energy required to keep the heating elements at a proper level of energization is reduced.

I claim:

1. An oven for heating film in a skin packaging machine comprising:

a rectangular-shaped housing having an exterior surface and a downwardly facing, open interior;

a plurality of inverted channel-shaped reflectors each including a flat base mounted to said housing and downwardly and outwardly flaring wings projecting from said base, said reflectors being mounted in said interior of said housing in parallel, spaced relation;

at least two electrical connectors mounted on said flat base of each said reflector;

a plurality of elongated heating elements, each of said reflectors receiving at least one of said heating elements mounted to said electrical connectors;

thermal insulative material surrounding said exterior surface of said housing; and control means for supplying high energy to said heating elements for a portion of the cycle of operations during which film is heated, and for supplying low energy to said heating elements for the remaining portion of the cycle of operations of the skin packaging machine.

* * * * *